US012577640B2

(12) United States Patent
Crook et al.

(10) Patent No.: US 12,577,640 B2
(45) **Date of Patent: *Mar. 17, 2026**

(54) WROUGHTABLE, CHROMIUM-BEARING, COBALT-BASED ALLOYS WITH IMPROVED RESISTANCE TO GALLING AND CHLORIDE-INDUCED CREVICE ATTACK

(71) Applicant: Haynes International, Inc., Kokomo, IN (US)

(72) Inventors: Paul Crook, Kokomo, IN (US); Ramanathan Krishnamurthy, Carmel, IN (US)

(73) Assignee: Haynes International, Inc., Kokomo, IN (US)

( * ) Notice: Subject to any disclaimer, the term of this patent is extended or adjusted under 35 U.S.C. 154(b) by 429 days.

This patent is subject to a terminal disclaimer.

(21) Appl. No.: 17/924,708

(22) PCT Filed: May 10, 2021

(86) PCT No.: PCT/US2021/031551

§ 371 (c)(1),
(2) Date: Nov. 11, 2022

(87) PCT Pub. No.: WO2021/231285

PCT Pub. Date: Nov. 18, 2021

(65) Prior Publication Data

US 2023/0183840 A1 Jun. 15, 2023

Related U.S. Application Data

(60) Provisional application No. 63/022,892, filed on May 11, 2020.

(51) Int. Cl.
*C22C 19/07* (2006.01)
*C22B 9/18* (2006.01)
(Continued)

(52) U.S. Cl.
CPC ..... *C22C 19/07* (2013.01); *C22B 9/18* (2013.01); *C22C 1/02* (2013.01); *C22F 1/002* (2013.01); *C22F 1/10* (2013.01)

(58) Field of Classification Search
CPC ... C22B 9/18; C22C 1/02; C22C 19/07; C22F 1/002; C22F 1/10
See application file for complete search history.

(56) References Cited

U.S. PATENT DOCUMENTS

| | | | | |
|---|---|---|---|---|
| 4,714,468 | A | 12/1987 | Wang et al. | |
| 10,751,446 | B2 * | 8/2020 | van Bennekom ..... | A61C 13/20 |
| 2019/0022275 | A1 | 1/2019 | van Bennekom et al. | |

FOREIGN PATENT DOCUMENTS

| | | | |
|---|---|---|---|
| CN | 1472353 | A | 2/2004 |
| CN | 102453908 | A * | 5/2012 |

(Continued)

OTHER PUBLICATIONS

NPL: on-line translation of CN 102453908 A, May 2012 (Year: 2012).*

(Continued)

*Primary Examiner* — Jie Yang
(74) *Attorney, Agent, or Firm* — Buchanan Ingersoll & Rooney PC

(57) ABSTRACT

A chromium-bearing, cobalt-based alloys amenable to wrought processing has improved resistance to both chloride-induced crevice corrosion and galling. The alloy contains up to 3.545 wt. % nickel, 0.242 to 0.298 wt. % nitrogen, and may contain 22.0 to 30.0 wt. % chromium, 3.0 to 10.0 wt. % molybdenum, up to 5.0 wt. % tungsten, up to 7 wt. % iron, 0.5 to 2.0 wt. % manganese, 0.5 to 2.0 wt. % silicon, 0.02 to 0.11 wt. % carbon, 0.005 to 0.205 wt. % aluminum, and the balance is cobalt plus impurities.

17 Claims, 1 Drawing Sheet

(51) Int. Cl.

| | |
|---|---|
| *C22C 1/02* | (2006.01) |
| *C22F 1/00* | (2006.01) |
| *C22F 1/10* | (2006.01) |

(56) References Cited

FOREIGN PATENT DOCUMENTS

| | | | |
|---|---|---|---|
| CN | 111575539 | A | 8/2020 |
| JP | S5410224 | A | 1/1979 |
| JP | 2002097913 | A | 4/2002 |
| JP | 2008111177 | A | 5/2008 |
| JP | 2011032530 | A | 2/2011 |
| WO | 97/00978 | | 1/1997 |

OTHER PUBLICATIONS

International Search Report for PCT/US2021/031551 dated Jul. 12, 2021.

Written Opinion of the International Searching Authority for PCT/US2021/031551 dated Jul. 12, 2021.

"Biocompatibility Evaluation and Corrosion Resistance of Tungsten added Co—30Cr—4Mo—1Ni Alloy" Amit Aherwar, et al., Bio-Medical Materials and Engineering 28 (2017) 687-701.

"Obtaining and Characterization of Biocompatible Co—Cr as Cast Alloys" Victor Geanta, et al., Key Engineering Materials vol. 583, Sep. 30, 2013, pp. 16-21.

Aherwar Amit et al : "Biocompatibility evaluation and corrosion resistance of tungsen added Co—30Cr—4Mo—1Ni Alloy", Bio-Medical Materials and Engineering: an International Journal, vol. 28, No. 6 ,Nov. 22, 2017 pp. 687-701, DOI: 10.3233/BME-171706.

* cited by examiner

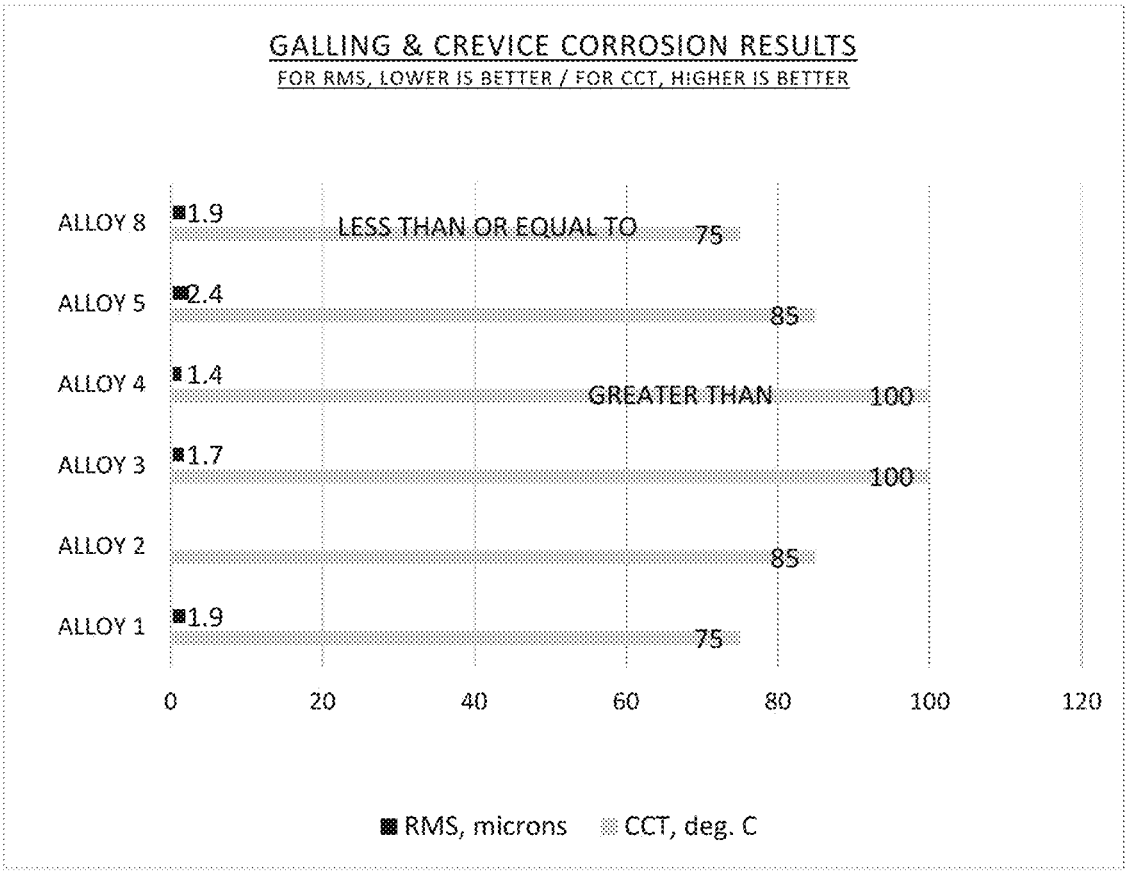
GALLING & CREVICE CORROSION RESULTS
FOR RMS, LOWER IS BETTER / FOR CCT, HIGHER IS BETTER
ALLOY 8
ALLOY 5
ALLOY 4
ALLOY 3
ALLOY 2
ALLOY 1
1.9
LESS THAN OR EQUAL TO
75
2.4
85
1.4
GREATER THAN
100
1.7
100
85
1.9
75
0
20
40
60
80
100
120
RMS, microns
CCT, deg. C

WROUGHTABLE, CHROMIUM-BEARING, COBALT-BASED ALLOYS WITH IMPROVED RESISTANCE TO GALLING AND CHLORIDE-INDUCED CREVICE ATTACK

FIELD OF INVENTION

The invention relates to cobalt-based corrosion resistant and wear resistant alloys.

BACKGROUND

Chromium-bearing, cobalt-based alloys have been used by industry for over a century to solve problems of wear under hostile conditions (i.e. in corrosive liquids and gases).

During this time, two major (wear-resistant) types have evolved, one containing tungsten and appreciable levels of carbon (approximately 1 to 3 wt. %), the other containing molybdenum, and much lower carbon contents. The former alloys exhibit significant amounts of carbide in their microstructures, which give rise to high bulk hardness, outstanding resistance to low stress (scratching) abrasion, but low ductility. The latter alloys exhibit only small quantities of carbide, if at all. Consequently, they are not as hard, but more ductile and corrosion-resistant.

An associated group of chromium-bearing, cobalt-based alloys, designed primarily for high strength at high temperatures, and applications in flying gas turbine engines, should be mentioned, since it also evolved from the aforementioned materials.

Despite popular belief, bulk hardness is not necessarily a good measure of general wear resistance. Indeed, there are forms of wear controlled more by the nature of the cobalt-rich matrix (than by the presence of microstructural carbides); these forms include galling (high load/low speed metal-to-metal sliding), cavitation erosion (caused by near-surface bubble collapse in turbulent liquids), and liquid droplet erosion.

As to the patent history of the chromium-bearing, cobalt-based alloys, the first such alloys were described by Elwood Haynes in U.S. Pat. No. 873,745 (Dec. 17, 1907). U.S. Pat. No. 1,057,423 (Apr. 1, 1913) by the same inventor claims alloys of cobalt, chromium, and tungsten, paving the way for evolution of the first major type (associated with the STELLITE trademark). The earliest U.S. patent disclosing the second major type of chromium-bearing, cobalt-based alloy was U.S. Pat. No. 1,958,446 (May 15, 1934), in which Charles H. Prange describes such alloys for use as cast dentures.

These early alloys were typically used in cast or weld overlay form. Wrought and powder metallurgy (P/M) products of a few alloys became available mid-20$^{th}$ Century.

To understand the roles of various alloying elements in cobalt-based alloys, it is important to have knowledge of changes that can occur in the atomic structures of pure cobalt and many of its alloys. At temperatures below approximately 420° C./788° F., the stable atomic structure of pure cobalt is hexagonal close-packed (HCP). At higher temperatures (up to the melting point), it is face-centered cubic (FCC). Elements such as nickel, iron, and carbon (within its limited soluble range) are known to decrease the transition (or transformation) temperature; i.e. they extend the temperature range of the FCC structure. Conversely, elements such as chromium, molybdenum, and tungsten increase the transition temperature (TT); i.e. they extend the temperature range of the HCP structure.

The transition of cobalt and its alloys from HCP to FCC, and vice versa, by thermal means is sluggish, and therefore these materials tend to exhibit a metastable FCC form at room temperature and thereabouts, upon cooling from their molten state, or upon cooling after periods of time above the TT. However, the application of mechanical stresses at temperatures below the TT can bring about the rapid formation of HCP regions within the metastable FCC structure. Such regions, which have the appearance of platelets (during metallographic examination), are thought to occur by the coalescence of stacking faults within the metastable FCC structure. The driving force for this stress-induced metastable FCC to HCP transformation at a given temperature is governed by the TT (i.e. the higher the TT, the greater is the tendency).

The influence of the TT upon the wear behavior of cobalt and its alloys is known to be profound, since the occurrence of HCP platelets under the action of mechanical stress results in rapid work-hardening, an important attribute in resistance to plastic deformation. Chromium, molybdenum, and tungsten, therefore, are known to be beneficial to wear resistance, in particular resistance to galling, cavitation erosion, and liquid droplet erosion. Conversely, nickel, iron, and carbon (at low levels, within its soluble range) should ostensibly be detrimental to wear resistance.

Chromium, molybdenum, and tungsten are also beneficial to the resistance of such materials to aqueous corrosion. As with stainless steels and nickel-based alloys, chromium provides passivity (protective surface films) in oxidizing acid solutions, while molybdenum and tungsten increase the nobility of cobalt and its alloys in reducing solutions, where the cathodic reaction is hydrogen evolution.

The prior art of greatest relevance to this invention is U.S. Pat. No. 5,002,731 (Mar. 26, 1991), the inventors being Paul Crook, Aziz I. Asphahani, and Steven J. Matthews. The commercial embodiment of this patent is known as ULTIMET alloy. U.S. Pat. No. 5,002,731 disclosed a cobalt-based alloy containing significant quantities of chromium, nickel, iron, molybdenum, tungsten, silicon, manganese, carbon, and nitrogen. It revealed an unanticipated benefit of carbon (augmented by the presence of nitrogen at a similar level) with regard to both cavitation erosion resistance and corrosion resistance. Furthermore, it revealed that the influence of nickel on cavitation erosion, at least, was not powerful over the content range 5.3 to 9.8 wt. %. The experimental, wrought materials used in the discoveries of Crook et al. were made by vacuum induction melting, electro-slag re-melting, hot forging and hot rolling (to sheets and plates), and by subsequent solution annealing. Interestingly, a maximum nitrogen content of 0.12 wt. % was claimed due to the fact that a higher level of 0.19 wt. % caused cracking problems during wrought processing.

Study of related prior art revealed chromium-bearing, cobalt-based alloys designed specifically for powder metallurgical processing, and use in the biomedical field. One example, described in U.S. Pat. No. 5,462,575, has chromium and molybdenum contents similar to those of ULTIMET alloy (the commercial embodiment of U.S. Pat. No. 5,002,731), and those of the alloys of this invention. However, it does not contain tungsten, and requires a special relationship between carbon and nitrogen. More importantly, U.S. Pat. No. 5,462,575 requires aluminum (along with other oxide forming metals, such as magnesium, calcium, yttrium, lanthanum, titanium, and zirconium) to be maintained at very low levels (i.e. these elements combined should not exceed about 0.01 wt. %).

The material properties with which this discovery is concerned are galling and crevice corrosion resistance. Galling is a term used for the damage caused by metal-to-metal sliding under very high loads, and in the absence of lubrication. It is characterized by gross plastic deformation of one or both surfaces, bonding between the surfaces, and (in most cases) transfer of material from one surface to the other. Most stainless steels are particularly prone to this form of wear, and tend to seize-up completely under galling test conditions.

Chloride-induced crevice corrosion occurs in crevices or narrow gaps between structural components, or under deposits on surfaces, in the presence of chloride-bearing solutions. The attack is associated with the localized build-up of positive charge, and the attraction of negatively charged chloride ions to the gap, followed by the formation of hydrochloric acid. This acid accelerates the attack, and the process becomes auto-catalytic. Crevice corrosion tests are also good indicators of chloride-induced pitting resistance.

SUMMARY OF THE INVENTION

We have discovered that a combination of a relatively low nickel content and a relatively high nitrogen content significantly enhances the galling resistance and chloride-induced, crevice corrosion resistance of wrought, chromium-bearing, cobalt-based alloys also containing nickel, iron, molybdenum, tungsten, silicon, manganese, aluminum, carbon, and nitrogen. The positive effects of reducing the nickel content to 3.17 wt. %, then still further to 1.07 wt. %, upon crevice corrosion resistance were wholly unexpected, as was the fact that alloys with nitrogen contents up to 0.278 wt. % could be hot forged and hot rolled into wrought products, without difficulty, at these lower nickel levels.

DESCRIPTION OF THE DRAWING

FIG. 1 is a chart of the crevice corrosion and galling test results reported in Table 2.

DESCRIPTION OF THE PREFERRED EMBODIMENTS

The experimental alloys involved with this discovery were made by vacuum induction melting (VIM), followed by electro-slag re-melting (ESR), to produce ingots of material amenable to hot working. Prior to hot working (i.e. hot forging and hot rolling), ingots were homogenized at 1204° C./2200° F. Based on prior experience with this class of alloys, a hot working start temperature of 1204° C./2200° F. was used for all experimental alloys. Annealing trials indicated that a solution annealing temperature of 1121° C./2050° F. was suitable for this class of materials, followed by rapid cooling/quenching (to create a metastable FCC solid solution structure at room temperature). To enable the manufacture of crevice corrosion test samples, annealed sheets of thickness 3.2 mm/0.125 inch were produced. To enable the manufacture of galling test pins and blocks, annealed plates of thickness 25.4 mm/1 inch were produced. Two batches of Alloy 1 and two batches of Alloy 3 were produced, due to insufficient material in a single batch for both types of test.

The actual (analyzed) compositions of the experimental alloys are given in Table 1.

TABLE 1

Compositions of Experimental Wrought Alloys

| ALLOY | Co | Ni | Cr | Mo | W | Fe | Mn | Si | C | N | Al | COMMENT |
|---|---|---|---|---|---|---|---|---|---|---|---|---|
| 1 (A) | 52.76 | 8.98 | 26.68 | 5.07 | 2.10 | 2.77 | 0.93 | 0.29 | 0.062 | 0.114 | 0.15 | Commercial Embodiment of U.S. Pat. No. 5,002,731 |
| 1 (B) | 53.61 | 8.90 | 26.63 | 4.85 | 2.29 | 2.93 | 0.78 | 0.23 | 0.067 | 0.127 | 0.09 | Commercial Embodiment of U.S. Pat. No. 5,002,731 |
| 2 | 60.10 | 3.32 | 26.64 | 5.11 | 2.06 | 2.78 | 0.91 | 0.30 | 0.066 | 0.109 | 0.13 | |
| 3 (A) | 58.07 | 3.17 | 28.12 | 4.90 | 2.04 | 2.71 | 0.90 | 0.29 | 0.067 | 0.262 | 0.12 | Alloy of this Invention |
| 3 (B) | 57.01 | 3.08 | 27.96 | 6.84 | 2.26 | 2.88 | 0.77 | 0.24 | 0.058 | 0.278 | 0.08 | Alloy of this Invention |
| 4 | 60.16 | 1.07 | 28.10 | 4.52 | 2.24 | 2.92 | 0.80 | 0.25 | 0.061 | 0.270 | 0.13 | Alloy of this Invention |
| 5 | 56.63 | 5.37 | 27.85 | 4.55 | 2.19 | 2.85 | 0.78 | 0.26 | 0.060 | 0.233 | 0.10 | |
| 6 | 56.60 | 3.01 | 29.54 | 4.94 | 2.19 | 2.69 | 0.73 | 0.25 | 0.062 | 0.367 | 0.10 | Cracked during Forging |
| 7 | 55.62 | 2.89 | 30.45 | 4.77 | 2.15 | 2.61 | 0.70 | 0.27 | 0.067 | 0.415 | 0.13 | Cracked during Forging |
| 8 | 65.47 | 3.08 | 25.01 | 3.78 | 1.37 | 1.05 | 0.42 | 0.05 | 0.023 | 0.095 | 0.08 | |
| 9 | 50.02 | 3.17 | 31.40 | 5.89 | 3.04 | 4.80 | 1.31 | 0.53 | 0.095 | 0.413 | 0.28 | Cracked during Forging |

The experimental steps taken during this work were as follows:

1. Melt and test an experimental version (ALLOY 1) of the commercial embodiment of U.S. Pat. No. 5,002,731, using the same melting, hot working, and testing procedures as intended for all the other experimental alloys. Two batches were required to make all the required samples.
2. Melt and test a reduced (approximately 3 wt. %) nickel version (ALLOY 2), with all other elements at the ALLOY 1 level.
3. Melt and test an increased (approximately 0.25 wt. %) nitrogen version (ALLOY 3), with nickel at approximately 3 wt. %, and all other elements at the ALLOY 1 level. Two batches were required to make all the required samples.

4. Melt and test a further reduced (approximately 1 wt. %) nickel version (ALLOY 4), with nitrogen at approximately 0.25 wt. %, and all other elements at the ALLOY 1 level.
5. Melt and test an intermediate (approximately 5 wt. %) nickel version (ALLOY 5), with nitrogen at approximately 0.25 wt. %, and all other elements at the ALLOY 1 level.
6. Melt and test a further increased (approximately 0.35 wt. %) nitrogen version (ALLOY 6), with nickel at approximately 3 wt. %, and all other elements at the ALLOY 1 level.
7. Melt and test an even further increased (approximately 0.40 wt. %) nitrogen version (ALLOY 7), with nickel at approximately 3 wt. %, and all other elements at the ALLOY 1 level.
8. Melt and test a version (ALLOY 8) wherein all elements other than nickel (at approximately 3 wt. %) and nitrogen (at approximately 0.10 wt. %) are at the low end of the range for the commercial embodiment of U.S. Pat. No. 5,002,731.
9. Melt and test a version (ALLOY 9) wherein all elements other than nickel (at approximately 3 wt. %) and nitrogen (at approximately 0.40 wt. %) are at the high end of the range for the commercial embodiment of U.S. Pat. No. 5,002,731.

It will be noted that the higher the nitrogen content of the experimental alloys, the higher is their chromium content. This was not deliberate, but is assumed to have resulted from higher chromium recoveries (than previously experienced) during melting of the materials. It is likely related to the use of "nitrided-chromium" charge material as a means of adding the nitrogen.

It was also the case that the actual nitrogen contents were generally higher than the aim nitrogen contents during this work. For example, the aim nitrogen content of Alloys 1 and 2 was 0.08 wt. %, whereas the actual contents were 0.114 (Alloy 1, Batch A), 0.127 (Alloy 1, Batch B), and 0.109 wt. % (Alloy 2). These variances are attributed to unanticipated, higher nitrogen recoveries during VIM/ESR melting and re-melting of the alloys.

Aluminum was added to the experimental alloys to react with, and remove, oxygen during primary melting (in the laboratory VIM furnace). Aluminum is very important in production-scale air-melting, where it is used to maintain the very high temperatures required during argon-oxygen decarburization (AOD), in addition to its function as a deoxidizer. Manganese was added to help with the removal of sulfur during melting, at the levels suggested by U.S. Pat. No. 5,002,731. The silicon and carbon levels used in the alloys of this invention are similar to those claimed in U.S. Pat. No. 5,002,731. Such levels have provided excellent weld-ability, in the intervening years. The additional benefits of carbon at these levels, namely excellent cavitation erosion and corrosion resistance were described in U.S. Pat. No. 5,002,731. The dual benefits of chromium, molybdenum, and tungsten regarding resistance to certain forms of wear and corrosion were described in the Background section of this document; all three of these elements were kept (during this work) within the same approximate ranges as claimed in U.S. Pat. No. 5,002,731. Iron was also added to the alloys of this invention within the range claimed in U.S. Pat. No. 5,002,731, its main benefit being tolerance of iron-contaminated scrap materials during furnace charging, with significant economic benefits.

The key additions to the wrought, cobalt-based alloys described herein are nickel and nitrogen. As already mentioned, the most important and surprising discovery of this work was the powerful, positive influence upon chloride-induced crevice corrosion resistance of reducing the nickel content in the commercial embodiment of U.S. Pat. No. 5,002,731 to 3.17 wt. % and below. Furthermore, given the prior art (particularly U.S. Pat. No. 5,002,731), it was unexpected that alloys with nitrogen contents above approximately 0.12 wt. % could be processed into wrought products without difficulty, which infers that lower nickel contents might have a positive influence upon the wrought-ability of these higher nitrogen alloys.

The fact that the three alloys (6, 7, and 9) with the highest nitrogen contents (0.367, 0.415, and 0.413 wt. %, respectively) cracked during forging might mean that the solubility of nitrogen has been exceeded, leading to the presence of one or more additional phases in the high temperature, ingot microstructure. If the nitrogen contents of these alloys were reduced to levels within the range 0.262 to 0.278 wt. % of alloys 3(A), 3(B), and 4 (plus or minus the normal manufacturing allowance for nitrogen of 0.02 wt. %), these modified alloys 6, 7, and 9 would likely not crack.

Regarding the effects of reducing the nickel content upon galling resistance, these appear to be non-linear (something that current wear theory would not predict). Indeed, it was only at nickel levels of 3.17 wt. % and below, that galling resistance exceeded that of Alloy 1 (the commercial embodiment of U.S. Pat. No. 5,002,731, albeit with a slightly elevated nitrogen content, due to the aforementioned melting variance).

The melting of alloys of this type under large-scale production conditions requires not only an aim content for each element, but also practical ranges, given the variances due to elemental segregation in cast (real-time) analytical samples, variances due to secondary melting (for example ESR), and variances due to chemical analyses. "Plus or minus" allowances during melting on each of the deliberate additions to the commercial embodiment of U.S. Pat. No. 5,002,731, to accommodate these variances, are as follows: chromium±1.5 wt. %; nickel±1.25 wt. %; molybdenum±0.5 wt. %; tungsten±0.5 wt. %; iron±1 wt. %; manganese±0.25 wt. %; silicon±0.2 wt. %; aluminum±0.075 wt. %, carbon±0.02 wt. %; nitrogen±0.02 wt. %. Cobalt, as the balance, does not need such an allowance. For cobalt-based alloys with lower nickel contents than the commercial embodiment of U.S. Pat. No. 5,002,731 (for example, HAYNES 6B alloy), the plus or minus allowance for nickel is 0.375 wt. %.

Although the tests were conducted on wrought forms of the compositions, improved resistance to chloride-induced crevice corrosion and galling would be present in other product forms such as castings, weldments, and powder products (for powder metallurgy processing, additive manufacturing, thermal spraying, and welding).

Test Results

The crevice corrosion test used in this work was that described in ASTM Standard G48, Method D. It involved sheet samples of dimensions 50.8×25.4×3.2 mm/2×1×0.125 inch, with TEFLON crevice assemblies attached. Method D enables determination of the critical crevice temperature (CCT) of a material, i.e. the lowest temperature at which crevice attack is observed in a solution of 6 wt. % ferric chloride+1 wt. % hydrochloric acid, over a 72 h (uninterrupted) period. The test temperature was limited in this work to 100° C./212° F., since the ASTM Standard does not address the equipment (i.e. autoclaves) required for tests at higher temperatures.

In order to differentiate between the experimental alloys under conditions conducive to galling, a modern, LASER-based, 3-D surface measurement system was employed to study the wear scars, along with galling test hardware and procedures established in 1980. These procedures involved twisting a pin (of diameter 15.9 mm/0.625 in) against a stationary block (of thickness 12.7 mm/0.5 in) ten times through an arc of 121°, using a hand-cranked, back-and-forth movement. A load of 2722 kg/6000 lb. was applied by means of a tensile unit (in compression mode), plus a (greased) ball bearing seated on a female cone machined onto the top of the pin.

The galling tests involved self-mated samples (i.e. the pins and blocks were of the same material) and LASER-based, high-precision measurements of the root mean squared (RMS) roughness of the block scars.

All tests involved with this work were duplicated, under identical conditions. The RMS values presented in Table 2 are averages from the two galling tests. The CCT values presented in Table 2 are the lowest temperatures at which crevice attack was observed, irrespective of whether one or both samples exhibited attack at that temperature.

A higher CCT indicates higher resistance to chloride-induced crevice corrosion. A lower RMS indicates higher resistance to galling, during (self-coupled) high load/low speed, metal-to-metal sliding.

TABLE 2

Crevice Corrosion and Galling Test Results

| ALLOY | CCT | RMS | COMMENT |
|---|---|---|---|
| 1 | 75° C. (Batch A Tested) | 1.9 microns (Batch B Tested) | Commercial Embodiment of U.S. Pat. No. 5,002,731 |
| 2 | 85° C. | | |
| 3 | 100° C. | 1.7 microns | Alloy of this Invention |
| 4 | Greater than 100° C. | 1.4 microns | Alloy of this Invention |
| 5 | 85° C. | 2.4 microns | |
| 8 | Less than or Equal to 75° C. | 1.9 microns | |

The results in Table 2 are shown in chart form in FIG. 1.

Table 3 contains the broad range and preferred range for chromium, iron, molybdenum, tungsten, silicon, manganese and carbon in the alloy disclosed in U.S. Pat. No. 5,002,731. Because the alloy of the present invention derives from the commercial embodiment of U.S. Pat. No. 5,002,731, we expect that any alloy having up to 3.17 wt. % nickel (plus the normal manufacturing allowance of 0.375 wt. %), 0.262 to 0.278 wt. % nitrogen (plus or minus the normal manufacturing allowance for nitrogen of 0.02 wt. %), and 0.08 to 0.13 wt. % aluminum (plus or minus the normal manufacturing allowance for aluminum of 0.075 wt. %), along with chromium, iron, molybdenum, tungsten, silicon, manganese and carbon in an amount within the ranges disclosed in U.S. Pat. No. 5,002,731 would have the same improved resistance to galling and chloride-induced crevice attack as the tested alloys that are disclosed here.

TABLE 3

Ranges for Cr, Fe, Mo, W, Si, Mn and C (Percent by Weight)

| | Broad Range | Preferred Range |
|---|---|---|
| Chromium | 22.0 to 30.0 | 24.0 to 27.0 |
| Iron | Up to 7 | 2.0 to 4.0 |
| Molybdenum | 3.0 to 10.0 | 4.5 to 5.5 |
| Tungsten | Up to 5.0 | 1.5 t0 2.5 |
| Silicon | 0.05 to 2.0 | 0.30 to 0.50 |
| Manganese | 0.05 to 2.0 | 0.50 to 1.00 |
| Carbon | 0.02 to 0.11 | 0.04 to 0.08 |

The manufacturing allowances/tolerances described above can be applied to the amounts of chromium, iron, molybdenum, tungsten, silicon, manganese, carbon and aluminum in the tested alloys of this invention to determine acceptable ranges for these elements in our alloy. Additionally, we expect that an alloy having up to 3.545 wt. % nickel and 0.242 to 0.298 wt. % nitrogen would have the same improved resistance to galling and chloride-induced crevice attack if the contents of chromium, iron, molybdenum, tungsten, silicon, manganese and carbon were identical to those claimed in U.S. Pat. No. 5,002,731.

Although we have described certain present preferred embodiments of our alloy it should be understood that the invention is not limited thereto, but may be variously embodied within the following claims.

We claim:

1. A chromium-bearing, cobalt-based alloy amenable to wrought processing with improved resistance to both chloride-induced crevice corrosion and galling, the alloy having a critical crevice temperature of at least 100° C. when tested according to ASTM Standard G48, Method D, and a root mean squared roughness not greater than 1.7 microns when subjected to a galling test in which a pin of diameter 15.9 mm/0.625 in. is twisted against a stationary block of thickness 12.7 mm/0.5 in. ten times through an arc of 121°, using a hand-cranked, back-and-forth movement and a load of 2722 kg/6000 lb. applied by means of a tensile unit in compression mode, plus a greased ball bearing seated on a female cone machined onto the top of the pin, comprising:

up to 3.545 wt. % nickel;
0.242 to 0.298 wt. % nitrogen;
22.0 to 30.0 wt. % chromium;
3.0 to 10 wt. % molybdenum;
up to 5.0 wt. % tungsten;
1.71 to 7 wt. % iron;
0.05 to 2.0 wt. % manganese;
0.05 to 2.0 wt. % silicon;
0.02 to 0.11 wt. % carbon;
0.005 to 0.205 wt. % aluminum; and
cobalt plus impurities as the balance.

2. The chromium-bearing, cobalt-based alloy of claim 1 comprising:

1.07 to 3.17 wt. % nickel;
27.96 to 28.12 wt. % chromium;
4.90 to 6.84 wt. % molybdenum;
2.04 to 2.26 wt. % tungsten;
2.71 to 2.92 wt. % iron;
0.77 to 0.90 wt. % manganese;
0.24 to 0.29 wt. % silicon;
0.058 to 0.067 wt. % carbon;
0.262 to 0.278 wt. % nitrogen;
0.08 to 0.13 wt. % aluminum; and
cobalt plus impurities as the balance.

3. The chromium-bearing, cobalt-based alloy of claim 1 comprising:

0.695 to 3.545 wt. % nickel;
26.46 to 29.62 wt. % chromium;
4.40 to 7.34 wt. % molybdenum;
1.54 to 2.76 wt. % tungsten;
1.71 to 3.92 wt. % iron;
0.52 to 1.15 wt. % manganese;
0.04 to 0.49 wt. % silicon;
0.038 to 0.087 carbon;
0.242 to 0.298 wt. % nitrogen;
0.005 to 0.205 wt. % aluminum; and
cobalt plus impurities as the balance.

4. The chromium-bearing, cobalt-based alloy of claim 1 comprising:

up to 3.545 wt. % nickel;
0.242 to 0.298 wt. % nitrogen;
4.5 to 5.5 wt. % molybdenum;
1.5 to 2.50 wt. % tungsten;
2.0 to 4.0 wt. % iron;
0.5 to 1.0 wt. % manganese;
0.30 to 0.50 wt. % silicon;
0.04 to 0.08 wt. % carbon;
0.005 to 0.205 wt. % aluminum; and
cobalt plus impurities as the balance.

5. The chromium-bearing, cobalt-based alloy of claim 4 comprising:

1.07 to 3.17 wt. % nickel;
0.262 to 0.278 wt. % nitrogen;
2.04 to 2.26 wt. % tungsten;
2.71 to 2.92 wt. % iron;
0.77 to 0.90 wt. % manganese;
0.058 to 0.067 wt. % carbon; and
0.08 to 0.13 wt. % aluminum.

6. The chromium-bearing, cobalt-based alloy of claim 4 comprising:

0.695 to 3.545 wt. % nickel;
1.71 to 3.92 wt. % iron; and
0.40 to 0.49 wt. % silicon.

7. The chromium-bearing, cobalt-based alloy of claim 4 comprising 24.0 to 27.0 wt. % chromium.

8. The chromium-bearing, cobalt-based alloy of claim 1 wherein the alloy is in a form selected from the group consisting of wrought products, castings, weldments, and powder products.

9. The chromium-bearing, cobalt-based alloy of claim 1 comprising 24.0 to 27.0 wt. % chromium.

10. The chromium-bearing, cobalt-based alloy of claim 1 comprising 26.46 to 29.62 wt. % chromium.

11. The chromium-bearing, cobalt-based alloy of claim 1 comprising 27.96 to 28.12 wt. % chromium.

12. The chromium-bearing, cobalt-based alloy of claim 1 comprising 4.90 to 6.84 wt. % molybdenum.

13. The chromium-bearing, cobalt-based alloy of claim 1 comprising 4.40 to 7.34 wt. % molybdenum.

14. The chromium-bearing, cobalt-based alloy of claim 1 comprising 0.08 to 0.13 wt. % aluminum.

15. The chromium-bearing, cobalt-based alloy of claim 1 comprising 0.058 to 0.067 wt. % carbon and/or 2.04 to 2.26 wt. % tungsten.

16. The chromium-bearing, cobalt-based alloy of claim 1 comprising 1.71 to 3.92 wt. % iron and/or 0.77 to 0.90 wt. % manganese.

17. The chromium-bearing, cobalt-based alloy of claim 1 comprising 2.71 to 2.92 wt. % iron and/or 0.52 to 1.15 wt. % manganese.

* * * * *